US007114535B2

(12) United States Patent
Hartness et al.

(10) Patent No.: US 7,114,535 B2
(45) Date of Patent: Oct. 3, 2006

(54) CIRCULAR MOTION FILLING MACHINE AND METHOD

(75) Inventors: Thomas P. Hartness, Greenville, SC (US); Mark W. Davidson, Greer, SC (US)

(73) Assignee: Hartness International, Inc., Greenville, SC (US)

( * ) Notice: Subject to any disclaimer, the term of this patent is extended or adjusted under 35 U.S.C. 154(b) by 0 days.

(21) Appl. No.: 10/650,490

(22) Filed: Aug. 28, 2003

(65) Prior Publication Data

US 2005/0045244 A1 Mar. 3, 2005

(51) Int. Cl.
*B05B 3/04* (2006.01)

(52) U.S. Cl. ..... 141/145; 141/1; 141/178; 141/180

(58) Field of Classification Search ..... 141/1, 141/129, 135, 144–146, 168, 178–180
See application file for complete search history.

(56) References Cited

U.S. PATENT DOCUMENTS

| | | | | |
|---|---|---|---|---|
| 766,329 | A | | 8/1904 | Cunning |
| 989,546 | A | | 4/1911 | Jensen |
| 1,058,096 | A | | 4/1913 | Phelps |
| 1,072,290 | A | | 9/1913 | Wood et al. |
| 1,073,067 | A | | 9/1913 | Ayars |
| 1,481,259 | A | | 1/1924 | Harrison |
| 1,538,406 | A | | 5/1925 | McCarty et al. |
| 1,583,767 | A | | 5/1926 | Akins et al. |
| 1,636,421 | A | | 7/1927 | Knott |
| 1,933,551 | A | | 11/1933 | Gaynor |
| 1,942,885 | A | | 1/1934 | Tevander |
| 2,270,709 | A | | 1/1942 | Pittaluga |
| 2,277,688 | A | | 3/1942 | Cattonar et al. |
| 2,350,692 | A | | 6/1944 | Milek |
| 2,611,524 | A | | 9/1952 | Taylor |
| 2,666,564 | A | | 1/1954 | Minard |
| 2,671,588 | A | | 3/1954 | Vogt |
| 2,723,790 | A | * | 11/1955 | Spiess, Jr. et al. ..... 141/3 |
| 2,730,279 | A | | 1/1956 | Enock |

(Continued)

FOREIGN PATENT DOCUMENTS

DE 4216721 11/1993

(Continued)

OTHER PUBLICATIONS

Int'l Search Report and Written Opinion for PCT/US2004/08506, Oct. 19, 2004.

(Continued)

*Primary Examiner*—David J. Walczak
*Assistant Examiner*—Peter deVore
(74) *Attorney, Agent, or Firm*—Dority & Manning, P.A.

(57) ABSTRACT

Continuous circular motion filling machine is provided for filling containers. The machine includes a rotating platform having an in-feed section disposed to receive empty containers and an out-feed section disposed to transfer filled containers from the rotating platform. A filling turret is disposed generally above the rotating platform and is rotatable at a speed corresponding generally to that of the rotating platform. The turret includes a plurality of filling elements movable between a rest position and a filling position as the turret rotates. Radially extensible and retractable indexing arms are spaced around the platform. The arms are at a retracted position at the in-feed section and are subsequently extended as the rotating platform rotates so as to index the containers into groups on the rotating platform between respective indexing arms. Each group of containers is arranged in a desired pattern and spacing between adjacent arms corresponding to a pattern and spacing of the filling elements.

51 Claims, 6 Drawing Sheets

U.S. PATENT DOCUMENTS 2,760,316 A 8/1956 Okulitch et al.
2,890,553 A 6/1959 Day et al.
2,921,425 A 1/1960 Seval
2,928,693 A 3/1960 Cannon, Jr.
3,012,811 A 12/1961 Sandrock
3,168,123 A 2/1965 Pellerino et al.
3,505,787 A 4/1970 Tiews
3,519,108 A 7/1970 Webb et al.
3,553,927 A 1/1971 Anglade, Jr.
3,553,932 A 1/1971 Rowekamp
3,555,770 A 1/1971 Rowekamp
3,555,773 A 1/1971 Rowekamp
3,648,427 A 3/1972 Raudat et al.
3,656,517 A 4/1972 Taylor et al
3,727,366 A 4/1973 Schlueter et al.
3,742,989 A 7/1973 Campbell et al.
3,754,637 A 8/1973 Carter et al.
3,771,284 A 11/1973 Boeckmann et al.
3,805,476 A 4/1974 Kawamura et al.
3,825,980 A 7/1974 Moore
3,826,293 A 7/1974 Cayton
3,856,059 A 12/1974 Hartness et al.
3,860,104 A 1/1975 Strauss
3,864,890 A 2/1975 Ullman
3,958,685 A 5/1976 McDonald et al.
3,971,190 A 7/1976 McGill
4,053,003 A * 10/1977 Ferrero et al. ..... 141/144
4,055,943 A 11/1977 Reichert
4,096,939 A 6/1978 Riggs et al.
4,126,163 A 11/1978 Hartness et al.
4,159,608 A * 7/1979 Masuda et al. ..... 53/282
4,169,621 A 10/1979 McGill
4,215,521 A 8/1980 Hartness
4,291,733 A 9/1981 Polderman
4,294,057 A 10/1981 Winiasz et al.
4,300,330 A 11/1981 Hartness
4,320,914 A 3/1982 Simon
4,335,761 A 6/1982 Peronek
4,446,672 A 5/1984 Raudat
4,483,436 A 11/1984 Krishnakumar et al.
4,522,238 A 6/1985 Minard
4,528,796 A 7/1985 Lemaire
4,532,968 A 8/1985 Leonard
4,533,038 A 8/1985 Richard
4,541,524 A 9/1985 McGill et al.
4,553,442 A 11/1985 Mazzorana
4,567,919 A 2/1986 Fogg et al.
4,585,369 A 4/1986 Manesse et al.
4,587,792 A 5/1986 Hartness et al.
4,588,001 A 5/1986 Leonard
4,655,029 A 4/1987 Weiss
4,697,691 A 10/1987 Zodrow et al.
4,723,649 A 2/1988 Hartness et al.
4,888,936 A 12/1989 Takahama et al.
5,029,695 A 7/1991 Kovara
5,035,270 A 7/1991 Herzog
5,052,166 A 10/1991 Ziegler et al.
5,074,103 A 12/1991 McDowell
5,174,430 A 12/1992 Ebira
5,212,930 A 5/1993 Raudat
5,219,405 A 6/1993 Weiss
5,257,888 A 11/1993 Kronseder
5,295,517 A 3/1994 Ahlers
5,295,523 A 3/1994 Gentile
5,313,764 A 5/1994 Kronseder
5,487,257 A 1/1996 Domeier et al.
5,487,461 A 1/1996 Focke et al.
5,501,253 A 3/1996 Weiss
5,522,439 A 6/1996 Hákansson et al.
5,533,552 A 7/1996 Ahlers
5,555,709 A 9/1996 Savigny et al.
5,588,282 A 12/1996 Hartness
5,595,221 A 1/1997 Lagneau
5,642,604 A 7/1997 Müller
5,657,615 A 8/1997 Müller
5,701,719 A 12/1997 Neukam
5,727,365 A 3/1998 Lashyro et al.
5,768,860 A 6/1998 Weaver
5,775,067 A 7/1998 Hawley
5,778,634 A 7/1998 Weaver et al.
5,797,249 A 8/1998 Hartness
5,862,649 A 1/1999 Benz
5,865,225 A 2/1999 Weiss
5,878,796 A * 3/1999 Phallen ..... 141/169
5,896,900 A 4/1999 Häring et al.
5,960,838 A 10/1999 Tietz et al.
5,975,159 A 11/1999 Persenaire et al.
5,979,147 A 11/1999 Reuteler
6,003,286 A 12/1999 Goodman
6,026,867 A 2/2000 Klarl
6,038,833 A 3/2000 Beringer
6,050,060 A 4/2000 Spatafora et al.
6,119,440 A 9/2000 Benner, Jr. et al.
6,141,943 A 11/2000 Hart et al.
6,148,589 A 11/2000 Fukui et al.
6,185,910 B1 2/2001 Achhammer
6,209,293 B1 4/2001 Powers
6,253,809 B1 7/2001 Paradies
6,269,615 B1 8/2001 Amborn et al.
6,276,409 B1 8/2001 Ellison
6,286,290 B1 9/2001 Fluck
6,334,473 B1 1/2002 Dumargue
6,341,630 B1 1/2002 Reinecke
6,343,628 B1 2/2002 Reinecke
6,354,427 B1 3/2002 Pickel et al.
6,393,800 B1 5/2002 Schwenke
6,474,368 B1 11/2002 Clüsserath et al.
6,494,238 B1 12/2002 Sindermann
6,520,316 B1 2/2003 De Guglielmo et al.
6,571,532 B1 6/2003 Wiernicki et al.
6,581,653 B1 6/2003 Servadei
6,612,095 B1 9/2003 Hartness
6,722,101 B1 4/2004 Hartness
2001/0002532 A1 6/2001 Murphy et al.
2001/0052216 A1 12/2001 Hiramoto et al.
2002/0139436 A1 10/2002 Rosen et al.
2003/0000969 A1 1/2003 Mie
2003/0037514 A1 2/2003 Hartness et al.
2003/0075547 A1 4/2003 Stocchi
2003/0106288 A1 6/2003 Hartness et al.
2003/0106779 A1 6/2003 Stocchi
2003/0116222 A1 6/2003 Spatafora

FOREIGN PATENT DOCUMENTS

FR 1195550 A 11/1959
GB 513260 10/1939

OTHER PUBLICATIONS

Internet Screen Print, Krones Filling Closing, et al., Jul. 5, 2002.
Pneumatic Scale Co Brochure, Easi-Flow Wine Filler et al.
Internet Screen Print, US Bottlers Fillers, Jul. 5, 2002.
Internet Screen Print, Pneumatic Scale Co Capping Equipment, Filler Equipment and Seamers, Jul. 5, 2002.
Internet Screen Print, FOGG Filler Company—Products, Jul. 5, 2002.
FOGG Filler Company, The Fill Newsletter, vol. 1, Issue 2, Oct. 5, 2001.
Internet Screen Print, SIG Beverages—SIG Simonazzi, Jul. 5, 2002.
Internet Screen Print, KHS, Inc., Innofill, et al., Jul. 5, 2002.
Krones Brochure, Counter-Pressure Filler, Type VP Pneumatic Valve, Jul. 1994.

* cited by examiner

CIRCULAR MOTION FILLING MACHINE AND METHOD

BACKGROUND

The present invention relates to an apparatus and method for filling containers, such as bottles and the like, with a liquid by conveying the containers through a filling machine.

Automated filling machines configured for filling any manner of container processed through the machine by a conveyor or the like are old and well known in the art. For example, a conventional high-speed filling machine typically uses a worm gear or screw-like device to receive containers (i.e., bottles) conveyed in single file and in contact with each other. The worm gear engages each container and spaces the containers apart a desired distance corresponding to the spacing of downstream filling valves. The containers are typically conveyed from the worm gear to a rotating star wheel that receives the containers in individual pockets or recesses. The star wheel may further convey the bottles to one or more additional star wheels, to a rotating table or platform of the filling machine, or may directly convey the bottles under the heads of the rotary filling machine. Examples of such filling machines are described, for example, in the following U.S. Pat. Nos. 2,666,564; 3,519,108; 4,053,003; 4,588,001; 6,253,809 B1; and 6,474,368 B2.

With the device according to U.S. Pat. No. 4,567,919, the containers are spaced apart on a conveyor by a pair of parallel screws and conveyed on the same conveyer directly to the filling valves of the rotary filler without the use of a star wheel.

U.S. Pat. No. 5,029,695 describes a star wheel having a plurality of circumferentially spaced orienting devices around its periphery. Each of the orienting devices includes moveable fingers which can readily assume the contour of different containers. However, the containers must still be indexed prior to being conveyed to the star wheel.

Conventional rotary filling machines of the type described above used in modern high-speed processing lines require relatively sophisticated drives, gearing, and control systems for ensuring precise coordinated movement between the different in-feed and out-feed star wheels, worm gears, and so forth. Also, the star wheel assemblies take up valuable floor space. A typical star wheel may be, for example, 4 feet in diameter. The star wheels also require maintenance and upkeep, and generally add to the overall cost of the filling operation.

Conventional rotary filling operations also generally process the containers in a single file or row through the filling machine, primarily due to the indexing functions of the worm gears and/or star wheels. To accomplish multiple parallel row filling operations with conventional star wheel indexing technology would require complicated and expensive gearing and drive arrangements and is not considered commercially viable. Multiple row filling is thus often provided by linear-type filling machines as described, for example, in U.S. Pat. No. 5,878,796. In this linear design, the containers are typically conveyed serially as a group into the filling machine and captured or indexed into position under filling nozzles or orifices. The containers are typically held fixed and motionless while they are filled. Once the containers are filled, the indexing mechanism releases the containers and the filled containers are conveyed out on the same conveyor and another grouping of containers in indexed into position for filling. The linear-type machines, however, also have drawbacks, particularly with respect to processing speed. The basic architecture of the rotary system design is clearly superior with respect to potential through-put of containers as compared to the linear systems. Also, the rotary systems make far more efficient use of floor space.

SUMMARY

Objects and advantages of the invention will be set forth in part in the following description, or may be obvious from the description, or may be learned through practice of the invention.

The present invention relates to improvements in a rotary filling machine that allow for a relatively simple yet efficient method for indexing containers conveyed to the machine while greatly simplifying the mechanical components needed to carry out the indexing function. The machine overall is greatly simplified without sacrificing speed or efficiency. Additionally, multiple rows of containers may be simultaneously processed through the rotary filling machine without adding to the complexity of the machine, resulting in significantly increased through-put numbers.

In accordance with the invention, a continuous circular motion filling machine is provided for filling containers conveyed thereto. The invention is not limited to any particular type of filling material, and may be used for filling containers with any type of flowable material or substance, such as liquids, powders, granular products, etc. In one particular embodiment, the machine includes a rotating platform having an in-feed section that is disposed to receive empty containers and an out-feed section disposed to transfer filled containers from the rotating platform. The platform rotates relative to a vertical rotating axis. In a particular embodiment, the rotating platform is a generally circular rotating member that receives the containers at the in-feed section from a separate in-feed conveyor, and transfers the containers at the out-feed section to a separate out-feed container. In an alternative embodiment, the rotating platform, in-feed conveyor, and out-feed conveyor may be defined by a continuous conveyor wherein the rotating platform section of the continuous conveyor is defined by a semi-circular portion of the continuous conveyor.

A filling turret is disposed generally above the rotating platform and rotates at a speed corresponding generally to that of the rotating platform. The filling turret includes a plurality of circumferentially disposed filling elements that are movable between a rest position and a filling position as the turret rotates between the in-feed and out-feed sections.

In a particular embodiment of the invention, the filling turret includes a plurality of circumferentially disposed filling heads. The filling heads are disposed generally above the rotating platform and rotate at a speed corresponding to the rotational speed of the platform. Each filling head comprises a grouping of the filling elements arranged in a pattern corresponding to a pattern of containers indexed in groups on the rotating platform. For example, in on particular embodiment, the turret may include eight filling heads, with each filling head having, for example, twenty-two filling elements. The filling elements associated with a particular respective filling head are controlled and operated generally simultaneously, as described in greater detail herein.

In a particular embodiment, a plurality of radially extensible and retractable indexing arms are circumferentially spaced around the rotating platform. At the in-feed section, the indexing arms are at a retracted position and are subsequently extended as the rotating platform rotates so as to index the containers into groups on the rotating platform. The groups are defined between the indexing arms and consist of at least one container. For example, a group may consist of a plurality of containers arranged in a single serial row between adjacent indexing arms. In an alternative embodiment, a group may consist of a plurality of containers arranged in multiple parallel rows between adjacent indexing arms. In still a different embodiment, a group may consist of a single container located between adjacent indexing arms. Each group of containers, regardless of its number of containers, is arranged between the indexing arms in a desired pattern and spacing that corresponds to the pattern and spacing of the filling heads on the rotating turret. In this manner, the filling heads are movable as the turret rotates from a rest position to a filling position subsequent to indexing of the containers on the platform for a filling operation.

In an alternative embodiment, the containers may be of a size and shape such that they may be conveyed on the rotating platform in continuous contact without the use of indexing arms. This may be the case, for example, where the containers are relatively large and the filling elements are circumferentially spaced to accommodate the size of the containers such that the space between filling elements within a filling head is the same as the space between adjacent filling elements of different filling heads.

In a particular embodiment, in-feed guide elements are disposed generally at the in-feed section so as to guide containers from an in-feed conveyor onto the rotating platform in a desired pattern. For example, the containers may be guided by the in-feed guide elements onto the rotating platform in a single serial row. In an alternative embodiment, the containers may be guided onto the rotating platform by the in-feed guide elements in multiple parallel rows. The in-feed guide elements extend around at least a portion of the circumference of the rotating platform beyond the circumferential location where the filling heads (or filling elements) are movable from their rest position to their filling position. In this way, the filling heads essentially capture the containers prior to the containers leaving the guide elements and prevent the containers from sliding or otherwise being propelled from the rotating platform. It is thus not necessary to provide guide or rail elements around the circumference of the rotating platform.

It may also be desired to include exit guide elements disposed generally at the exit section of the rotating platform. The exit guide elements are disposed so as to convey the filled containers from the rotating platform onto an out-feed conveyor. The filling heads are movable from their filling position (wherein they essentially capture the containers) to their rest position after the containers are moved into the exit guide elements. Again, this serves the purpose of ensuring that the containers are at all times securely conveyed and cannot tip over or slide off of the platform.

If used, the indexing arms may be controlled to automatically move to their retracted position at the in-feed and out-feed sections of the rotating platform so that the containers are conveyed onto the platform in a generally continuous contacting sequence. After the containers have been transferred onto the rotating platform, the indexing arms are subsequently automatically extended from their retracted position so as to index the containers into a predetermined pattern or grouping between the indexing arms. A particularly effective and simple mechanism for controlling the automatic functions of the indexing arms is by way of a cam actuated system wherein the arms include a cam follower that travels along a cam race surface, the race surface having a particular configuration so as to withdraw or retract the indexing arms at the in-feed and out-feed sections, and to extend the arms for indexing the containers as described above. It should be appreciated, however, that alternative methods are available for controlling the indexing arms, including mechanical drive systems, spring systems, etc. All such control systems are within the scope and spirit of the invention.

The filling heads are movable between their rest and filling positions as the filling heads rotate with the filling turret. In a particular embodiment, the filling heads are movable in a vertical direction. The heads are at their rest position generally at the in-feed and out-feed sections of the rotating platform so that empty containers can be conveyed onto the platform at the in-feed section, and filled containers can be transferred off of the platform at the out-feed section. In a particular embodiment, the filling heads may be movably supported on generally vertically oriented support arms or members that are circumferentially spaced around the filling turret. The filling heads may be driven in reciprocating vertical paths on the support arms by any suitable drive mechanism. For example, in one particularly suitable arrangement, the filling heads are driven on the support arms by a cam drive system wherein the filling heads include cam followers engaged within a stationary cam track. The track has a configuration such that, as the filling turret rotates, the cam followers cause the filling heads to be moved vertically on their respective support arms.

As mentioned, after the containers have been indexed on the rotating platform, the filling head is moved from its rest position to a filling position wherein individual filling elements of the filling head engage with individual respective containers. At this point, a filling operation may be commenced, as described in greater detail below. Once the filling operation is completed, the containers can be directed from the rotating platform. In this regard, it should be understood that the filling operation may be completed within a relatively short rotational arc of the rotating platform, and that the out-feed section may be defined at this location. For example, the out-feed section may be defined at an arc position of 90 degrees, 180 degrees, 270 degrees, and so forth. In a desirable embodiment, the out-feed section is defined generally adjacent the in-feed section so that the containers are conveyed from the rotating platform in a direction generally parallel to but opposite their in-feed direction.

It may be desired to maintain the filling heads in their filling position until the containers are conveyed from the rotating platform, or at least conveyed into exit guide elements, even if the filling operation is completed before the out-feed section. As mentioned above, this arrangement serves to ensure that the containers are positively guided and captured as they are conveyed on the rotating platform.

The filling heads are individually supplied with a filling material, such as a liquid, slurry, powder, etc., from a central location. For example, a reservoir may be disposed generally atop of the rotating turret, with the filling heads comprising accumulator tanks supplied with a liquid from the reservoir by way of a flexible coupling. The flexible coupling allows the filling heads to move vertically with respect to the reservoir. It should be appreciated that various arrangements of tanks, reservoirs, and the like may be utilized in this regard.

The filling elements associated with each filling head are in fluid communication with the accumulator tank and include valve elements having an open position for dispensing liquid into the containers, and a closed position for preventing the dispensing of liquid after the containers are filled. An advantageous feature of the system according to the invention relates to the fact that multiple filling elements are simultaneously operated and controlled by a single filling head. For example, each filling head may comprise a central control member, such as a supply/electrical manifold assembly, wherein the control member is supplied with any combination of electrical or pneumatic lines for the actuation and control of the individual filling elements. For example, depending on the type of liquid or beverage being filled, each filling element may require a number of pneumatic lines for a filling sequence, such as a vent line, a purge line, a pressurized air line, and so forth. The invention is not limited by the type of filling head or filling requirements of each head. The filling element requirements would be supplied to the filling head central control member, and the filling elements would in turn be connected to the control member. For example, multiple pneumatic lines may be connected to the control member (i.e. a manifold mounted externally or internally of the filling head). The individual filling elements would then be connected directly to the manifold such that all of the filling elements are supplied from the manifold and operated generally simultaneously in a filling sequence. In a particular embodiment, the filling elements may be supplied from the manifold by a common header such that only a single connection line is needed from the manifold to the filling elements. In an alternate embodiment, each of the filling elements may be individually connected to the control member manifold. Any manner of conventional quick disconnects, connectors, and so forth may be used in this regard.

As mentioned, the groups of containers may be conveyed in direct contact against each other between the indexing arms. In this embodiment, the indexing arms have a width and circumferential spacing to ensure that the individual containers within a group are generally aligned with the filling elements of a respective filling head. The indexing arms may comprise a shaped tip at their radial end having an angled surface at a following (upstream) side of the arm in a direction of rotation of the rotating platform. In this manner, upon extension of the indexing arms from their retracted position, line pressure of the containers is relieved to the following side of the arms, generally upstream to the in-feed conveyor.

In an alternate embodiment, the indexing arms are variably positionable in a radial direction and include an angled or curved leading edge surface. The spacing of containers between the indexing arms can be varied by adjusting the degree of radial extension of the indexing arms. In this manner, containers of different size may be processed without changing the filling heads or filling elements within the heads. For example, in one embodiment, in-feed guide elements are disposed at the in-feed section of the platform so as to guide the containers onto the rotating platform in a single serial row. The indexing arms are of a number and spacing so as to be extendable between each of the containers. In other words, only a single container is indexed between adjacent arms. The radially extended position of the arms will dictate the circumferential spacing of the containers. The machine may thus be easily converted for containers of a different size merely by adjusting the extension position of the arms such that the containers are contacted along a different location of the angled surface of the arms. This feature may add significantly to the versatility of the filling machine.

The present invention also includes various embodiments of methods for filling containers with a liquid in an automated filling operation. The methods incorporate many of the operational characteristics described above. For example, in a particular embodiment, the method entails conveying a generally continuous stream of adjacent contacting containers to an in-feed section of a circular filling machine. At the in-feed section, the continuous stream of containers are transferred onto a generally circular rotating path. After the transferring step, the continuous stream of containers may be indexed while they rotate on the rotating path into groups having a desired number of containers in each group. Alternatively, the containers may be transferred and conveyed along the circular rotating path without indexing. Subsequently, the groups of containers are engaged with respective rotating filling heads, the filling heads having filling elements that engage with the individual containers within the groups. The containers are then filled by way of the filling heads as they are conveyed along an arcuate portion of the circular rotating path.

Various other method embodiments according to the invention include operational principals of the filling machine as described herein.

Embodiments of the invention will be described in greater detail below by reference to the appended figures.

DETAILED DESCRIPTION

Reference will now be made in detail to embodiments of the invention, one or more examples of which are illustrated in the figures. Each embodiment is presented for purposes of explaining the invention, and not meant as a limitation of the invention. For example, features illustrated or described as part of one embodiment may be used with another embodiment to yield still a different embodiment. It is intended that the invention include these and other modifications and variations as come within the scope and spirit of the invention.

Figure 1:
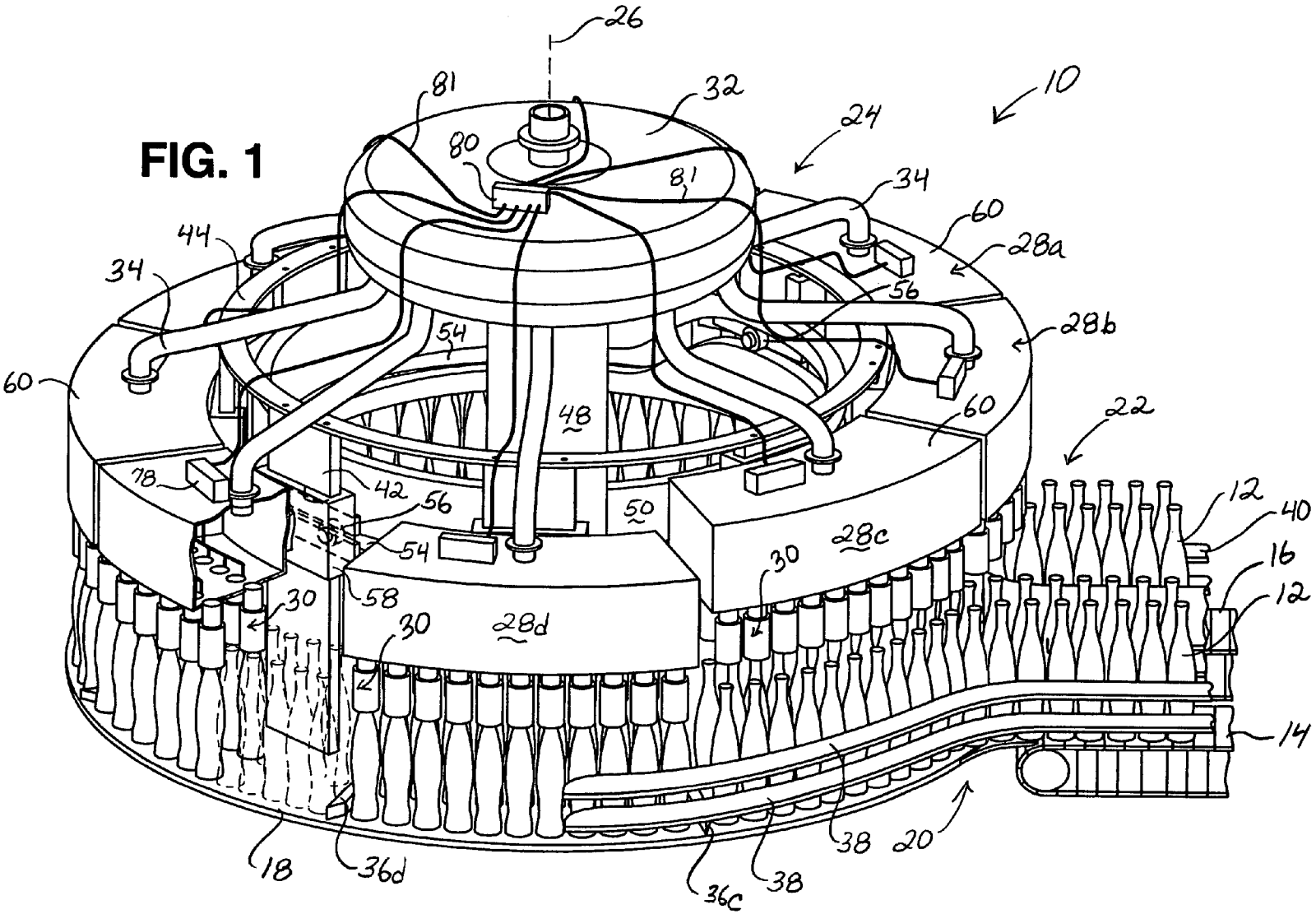
FIG. 1 is a perspective view of a rotary filling machine in accordance with the invention with certain compartments shown in partial cut-away view.
Figure 2:
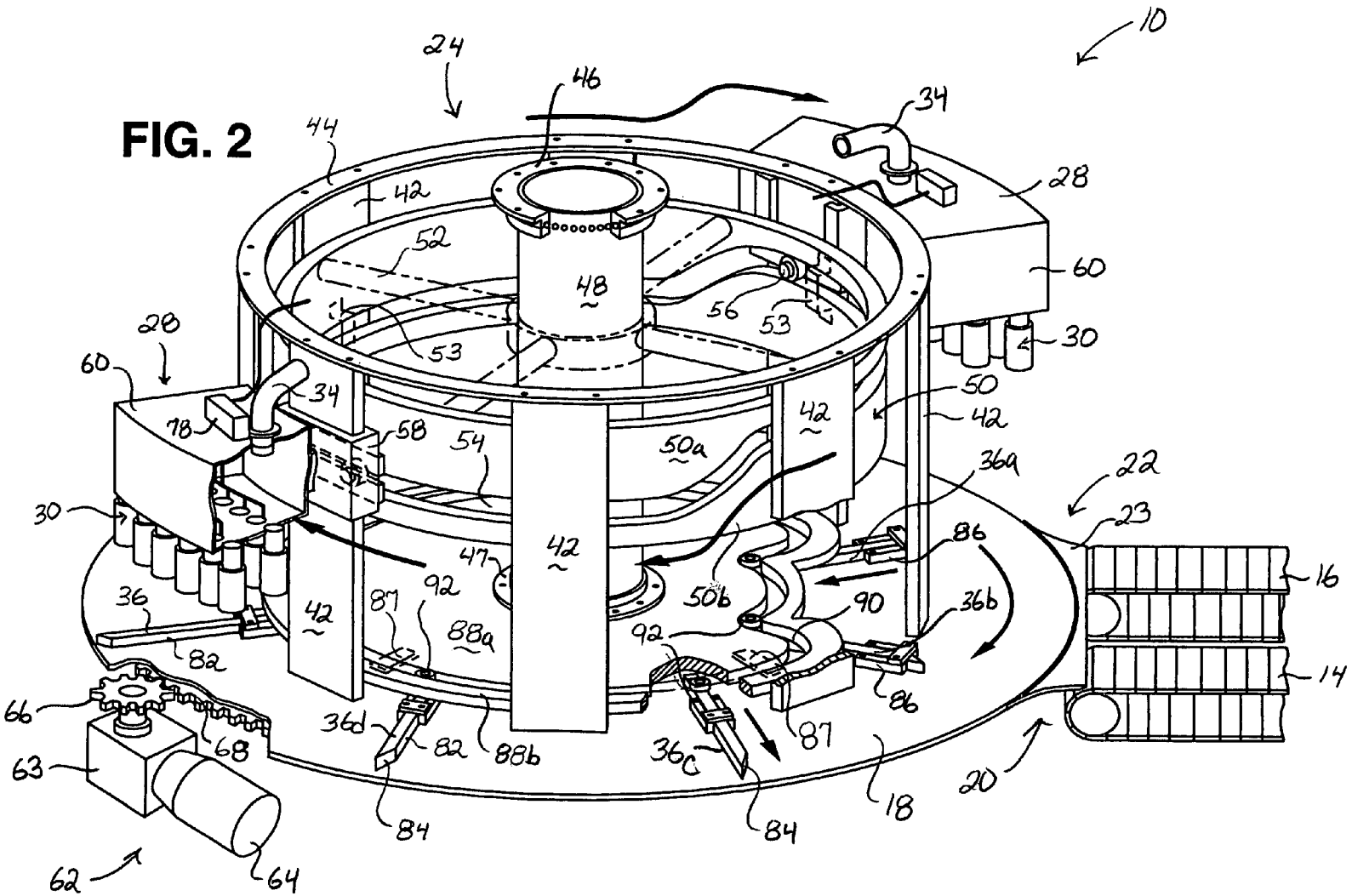
FIG. 2 is a perspective view of the rotary filling machine shown in FIG. 1 with certain components removed for clarity.

Referring to FIGS. 1 and 2 in general, a continuous circular motion rotary filling apparatus 10 in accordance with one embodiment of the invention is illustrated for filling containers 12 conveyed thereto. It should be understood that method embodiments according to the invention are also depicted in the figures. The machine 10 and associated method are not limited to filling of any particular size or shape of container 12. The containers 12 are illustrated in the figures as conventional long-necked bottles for purposes of illustration only. As will become evident, the machine 10 is particularly useful and well-adapted for filling various size and shape containers with relatively little reconfiguration of the machine.

The machine 10 includes a rotating platform, generally 18 having an in-feed section 20 and an out-feed section 22. At the in-feed section 20, containers 12 are transferred from an in-feed conveyor 14 onto the rotating platform 18. Similarly, at the out-feed section 22, filled containers 12 are transferred from the rotating platform 18 onto an out-feed conveyor 16. The in-feed and out-feed conveyors 14, 16, may comprise any configuration of conventional conveyor, and are illustrated in the drawings as conventional link conveyors.

In the illustrated embodiments, the rotating platform 18 is a generally circular rotating plate member, as particularly illustrated in FIG. 2. The rotating platform 18 rotates about a vertical axis 26 (FIG. 1). In this embodiment, a stationary bridge 23 may be disposed at the in-feed 20 and out-feed sections 22 to move the containers 12 from the in-feed conveyor 14 onto the rotating platform 18, and off of the rotating platform 18 and onto the out-feed conveyor 16. In an alternative embodiment not illustrated in the figures, the rotating platform 18 may be defined by a circular portion of a conveyor that is continuous with the in-feed conveyor 14 and out-feed conveyor 16. In other words, a single continuous conveyor may be used to convey the containers 12 to an in-feed section 20 where the containers 12 are then conveyed in a generally circular path to an out-feed section 22 wherein the containers are then directed away from the filling machine 10 by the same conveyor. It should be appreciated by those skilled in the art that various configurations of conveying systems may be utilized for practicing the invention, and that all such configurations are within the scope and spirit of the invention.

A filling turret 24 is disposed generally above the rotating platform 18 and rotates relative to the vertical axis 26 at a rotational speed that corresponds generally to that of the rotating platform 18. In this regard, the rotating turret 24 and platform 18 may be driven by a common drive mechanism, as described in greater detail below.

Figure 5:
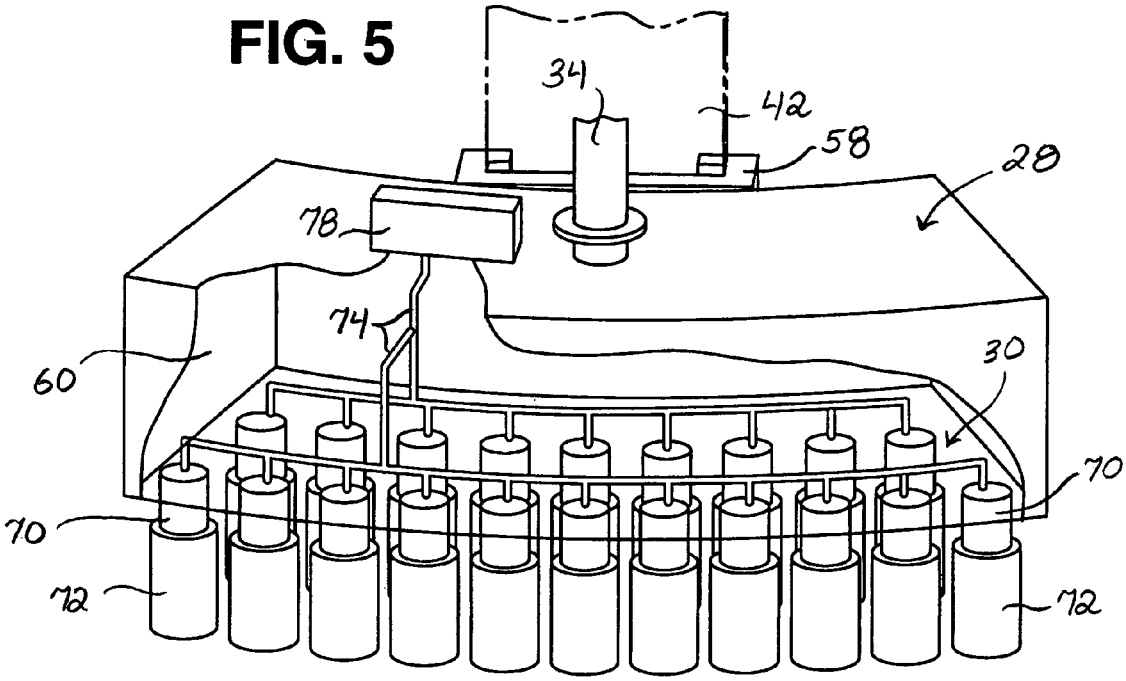
FIG. 5 is a perspective and partial cut-away view of a filling head in accordance with an embodiment of the invention.

The filling turret 24 includes a plurality of radially disposed filling elements, generally 30, that are movable from a rest position relative to the containers 12 to a filling position wherein the filling elements 30 engage with the containers 12 for a filling operation. In a particular embodiment, the filling elements 30 may be individually supplied and controlled. In the illustrated embodiments, the filling elements 30 are configured in groups with respective filling heads 28. Each filling head 28 includes an accumulator tank 60 in which a grouping of individual filling heads 30 are configured. Each accumulator tank 60 is in turn in communication with a central reservoir 32 by way of, for example, flexible coupling hoses 34. Referring to FIGS. 1 and 5, the individual filling elements 30 in this particular embodiment are arranged in parallel serial rows wherein the outer radial row contains a greater number of elements 30 as compared to the inner radial row. It should be appreciated that the number of elements in each of the rows will be a function of the circumferential spacing and size of the elements, as well as the radial placement of the elements 30 with respect to the axis 26.

Referring particularly to FIG. 1, the individual filling heads 28 are movable from a rest position wherein the heads 28 are displaced far enough from the containers 12 such that the containers may be conveyed onto the rotating platform 18. Referring to FIG. 1, the heads 28*a*, 28*b*, and 28*c* are shown in their rest position at the in-feed and out-feed sections 20, 22, respectively. In the illustrated embodiment, the heads 28 are vertically displaceable on vertical support members 42 so as to be automatically moved between their respective rest and filling positions. A particularly effective yet simple mechanism for carrying out this operation is illustrated in FIG. 2.

Figure 7:
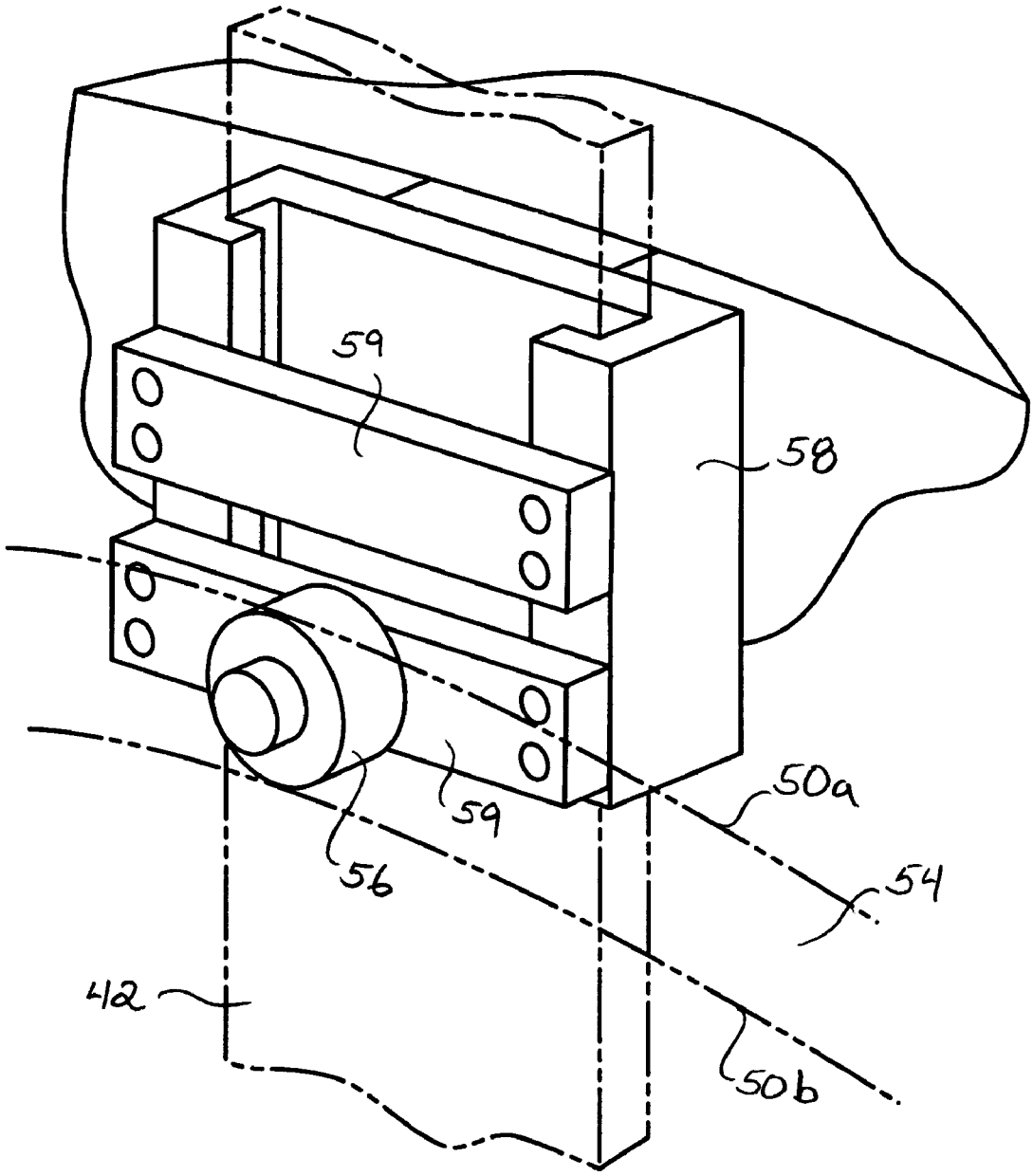
FIG. 7 is an enlarged perspective view illustrating a cam actuated mechanism for the filling heads.

Referring to FIGS. 2, 5, and 7 in particular, each respective filling head 28 is vertically slidable along a vertical support member 42. The vertical support members 42 are circumferentially spaced around the rotating platform 18 and are configured so as to rotate with the platform 18. For example, the vertical supports 42 may be mounted on the platform 18 radially inward of the circumferential portion of the platform 18 on which the containers 12 are conveyed. The vertical supports 42 may be supported at their upper ends by an upper frame member 44. Each filling head 28 includes a slide block 58, or other suitable bearing member, that is shaped to receive and slide vertically along a support member 42. For example, referring particularly to FIG. 7, the slide block 58 may comprise a relatively simple slotted member held onto a respective vertical support 42 by way of braces 59. Various other configurations are within the scope of the invention. It may also desirable that the filling heads 28 are removably attached to their respective slide block 58. In this way, the filling heads 28 are interchangeable with heads having a different number, pattern, or size of filling elements 30. Thus, the machine 10 can be easily reconfigured to accommodate containers of different size and shape.

Each of the block members 58 includes at least one cam follower 56 that moves along a cam track 54 defined in a stationary cam track member 50. Referring particularly to FIG. 2, cam track member 50 may be defined by an upper member 50*a* and a lower member 50*b*. The cam track 54 is defined between the upper member 50*a* and lower member 50*b* and has a circumferential shape so that as the vertical supports 42 are rotated relative to the cam track 54, the filling heads 28 follow the path indicated by the bold arrow lines in FIG. 2. In particular, referring to FIG. 1, the filling heads 28 are driven to their rest position at the in-feed section 20 such that the containers 12 are conveyed onto the rotating platform member 18 at the in-feed section 20 without being contacted by the filling heads 28 or filling elements 30. Once the containers 12 have been conveyed and indexed on the platform 18 as the platform and filling heads rotate, as described below, the cam track 54 causes the filling heads 28 to be lowered into their filling position, as shown by the filling head 28*d* in FIG. 1. The filling heads 28 stay in this filling position until caused to reciprocate vertically upward at the out-feed section 22, as indicated by the filling head 28*a* in FIG. 1.

In the illustrated embodiment, the cam track members 50*a* and 50*b* are stationarily supported relative to a fixed vertical support member 48 by way of, for example, radial support arms 52 illustrated diagrammatically in FIG. 2. In should be appreciated that the upper and lower cam track members 50*a* and 50*b* may be individually supported so as to define an unobstructed circumferential cam track 54. Any suitable support structure may be configured by those skilled in the art for supporting the stationary cam track members 50*a* and 50*b* relative to the rotating turret 24, particularly the vertical supports 42 and rotating member 18. Alternatively, the members 50*a* and 50*b* may be connected by braces 53 extending across the cam track 54. In still another embodiment, the cam track member may be a unitary member with the track defined as a groove or recess in one side thereof.

It should also be appreciated that the cam actuation system described herein for automatically driving the filling heads 28 in their reciprocating vertical path as they rotate is but one of any manner of suitable drive mechanism. For example, the heads 28 may be motor driven by a common motor, individual motors, and so forth in alternate embodiments. The invention is not limited by any particular drive mechanism for the movable filling heads 28 so long as the drive mechanism operates to automatically move the filling heads 28 in a timed sequence as described herein.

It is important that the containers 12 are conveyed on the rotating platform 18 in a desired grouping corresponding to the number and pattern configuration of the filling elements 30. Depending on the size and shape of the containers, this may be accomplished merely by conveying the containers in serial contact with each other on the rotating platform 18 without otherwise physically indexing the containers. The individual filling elements 30 would have a uniform circumferential spacing corresponding to the spacing between the container openings. Thus, if the filling elements 30 were configured in groups in respective filling heads 28, the spacing between adjacent filling elements 30 of different heads 28 would be the same as the spacing between filling elements 30 within a filling head 28.

In an alternate embodiment illustrated in the figures wherein a plurality of the filling elements 30 are associated in a pattern with a respective filling head 28, the containers 12 are be indexed into a corresponding pattern so that when the filling heads 28 move from their rest position (position of element 28*c* in FIG. 1) to the filling position (position of filling head 28*d* in FIG. 1), the individual elements 30 will properly mate with containers 12 for the subsequent filling operation. In the illustrated embodiment, the pattern of filling elements 30 and container groupings is in parallel serial rows for each filling head 28. For example, referring to FIG. 5, each filling head 28 includes a pattern of filling elements 30 having an outer radial row of elements with eleven elements 30, and an inner parallel row containing nine filling elements 30. However, the bottles 12 are conveyed on the in-feed conveyer 14 in contacting serial arrangement, and are not indexed into groups of any sort. A unique system for indexing the bottles after they have been conveyed onto the platform 18 in accordance with the invention is illustrated particularly in FIGS. 1, 2, and 4.

Referring to the cited figures, a plurality of radially oriented indexing arms 36 are circumferentially spaced around the platform 18. Each arm 36 is movable between a retracted position and an extended position. The arms 36 are automatically retracted at the in-feed and out-feed sections 20, 22, as indicated by the arms 36*a* and 36*b* in FIG. 2, so that the containers 12 may be moved from the in-feed conveyor 14 onto the platform 18 in serial contacting relationship, and moved from the platform 18 onto the out-feed conveyor 16 without interference from the arms 36. In the illustrated embodiment, the arms 36 are shown as relatively simple elongated rectangular members. However, it should be appreciated, that the arms 36 may take on any suitable size or configuration depending on the nature of the containers 12 processed through the machine 10.

Figure 4:
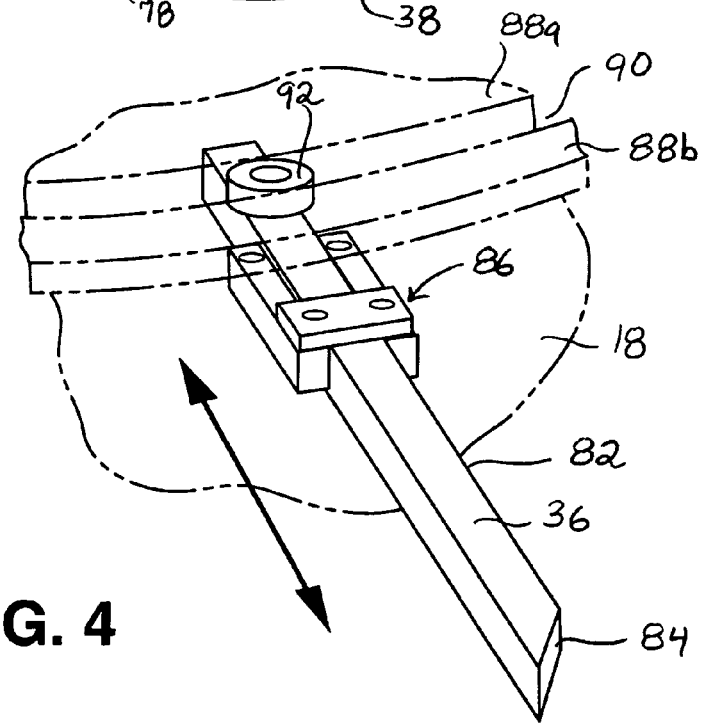
FIG. 4 is a perspective view of an embodiment of indexing arms used in a rotary filling machine in accordance with an embodiment of the invention.

Each indexing arm 36 is mounted relative to the rotating platform member 18 so as to rotate therewith. In a relatively simple arrangement as indicated in FIG. 4, the arms 36 are slidable within bearing blocks 86, the blocks 86 mounted directly on the platform member 18. It may be desired that the blocks 86 are variably positionable on the platform 18 so that the spacing of the arms 36 may be easily varied to accommodate container groupings of a different number or pattern, or containers of a different size. The arms 36 are driven between their retracted position and extended positions as the platform 18 rotates by, for example, a cam actuation system as illustrated in the figures. In particular, each arm 36 includes a cam follower 19 that travels along a cam track 90 defined by stationary cam track members 88*a* and 88*b*. At the in-feed and out-feed sections 20, 22, the cam track 90 has a course such that the arms 36 are automatically retracted at the in-feed and out-feed locations. It should be understood that the cam track members 88*a* and 88*b* are stationary relative to the rotating platform 18 and rotating vertical support members 42. For example, the members may be stationarily supported on the vertical frame member 48 by way of a lower flange 47 at a height above the rotating platform member 18 so as to allow the arms 36 to retract beneath the cam track members, as illustrated in FIG. 2. Although not particularly illustrated in FIG. 2, it is understood that cam track member 88*b* would also be stationarily supported relative to the rotating platform member 18. For example, the cam track member 88*b* may be supported by the inner radial member 88*a* by braces 87. In an alternative embodiment, the cam track member 88 may be defined by a unitary member wherein the cam track 90 is defined by a circumferential groove or recess defined in the unitary member. In an alternative embodiment, the cam track 90 may be defined by the outer circumferential surface of a single member, such as member 88*a*, wherein the individual index arms 36 are spring loaded against the outer circumferential surface of the member. It should be appreciated by those skilled in the art that various suitable drive systems may be utilized for automatically moving the indexing arms 36 between their retracted and extended positions in a timed sequence according to the invention.

Figure 3:
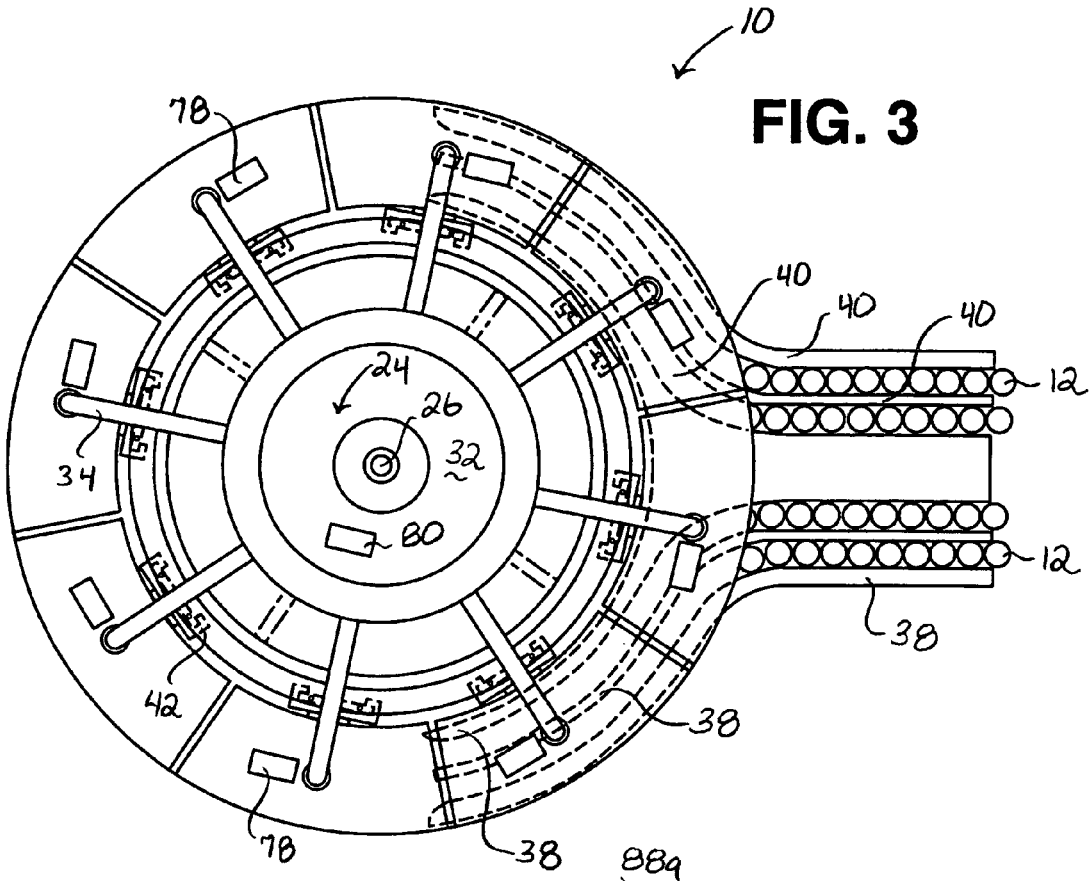
FIG. 3 is a top plan view of the rotary filling machine of FIG. 1.

Referring particularly to FIG. 1, the containers 12 are moved from the in-feed conveyor 14 onto the rotating platform member 18 at the in-feed section 20 such that the containers are in a generally serial contacting arrangement. In-feed guide elements 38 may be disposed at the in-feed section 20 so as to extend from the in-feed conveyor 14 along at least a circumferential portion of the rotating platform 18. Referring to FIG. 3, any number and arrangement of guide elements 38 may be utilized to arrange the containers 12 into the desired number of parallel serial rows. In the illustrated embodiment, the containers 12 are arranged into two parallel serial rows on the rotating platform 18 by way of the in-feed guide elements 38. The guide elements 38 may take on any shape or configuration, and in the illustrated embodiment are shown as relatively simple rail members extending above and alongside of the platform 18 and in-feed conveyor 14.

Referring to FIG. 1, it can be seen that the filling head 28*c* is held in its rest position as the containers 12 are transferred onto the rotating platform 18 prior to the containers 12 being sequenced into corresponding groups. Referring to FIG. 2, index arm 36*b* is automatically driven to its retracted position so that the containers 12 can be conveyed onto the platform 18 uninhibited by the index arms. As the platform member 18 continues to rotate, the index arm is driven to its extended position as illustrated by the arms 36*c* and 36*d* in FIGS. 1 and 2. Thus, once the arms 36 are driven to their extended position, a defined number of containers 12 are grouped or indexed between adjacent arms, as particularly illustrated in FIG. 1. The arms are circumferentially spaced according to the size of the containers 12 and spacing of the filling elements 30 of the respective filling heads 28 so that once adjacent arms 36 are extended, a predefined grouping or pattern of the containers 12 is captured between respective arms 36.

Referring to FIG. 1, it can be seen that the head 28*d* is not driven to its filling position until after the arm 36*c* is driven to its extended position. Also, the in-feed guide elements 38 extend circumferentially beyond the location where the filling heads 28 are driven to their filling position to ensure that the containers 12 are at all times positively captured and cannot slide or be knocked off of the platform 18. Once the head 28*d* has been lowered into its filling position, the filling elements 30 engage with each individual respective container 12, thus ensuring that the containers are held in relative position. Thus, the guide elements 38 need not extend beyond the circumferential location where the filling heads 28 are lowered, as illustrated in FIG. 1.

Referring to FIG. 4, each of the indexing arms 36 desirably includes an angled radial tip 84. Tip 84 has an angled surface that faces the following (upstream) side 82 of the arm. Thus, as an arm 36 is moved from its retracted position to its extended position as indicated by the arrow in FIG. 4, the angled surface 84 engages against the upstream containers 12 and relieves any line pressure of the containers 12 in the upstream direction towards the in-feed conveyor 14.

Once the containers 12 have been indexed by the indexing arms 36 into groups having a number and pattern of containers 12 corresponding to the number and pattern of filling elements 30 of each respective filling head 28, the filling heads move to the filling position as indicated by the head 28*d* in FIG. 1. At this point, a filling operation may be commenced wherein the individual containers 12 are filled with a liquid supplied to the filling heads 28 from a reservoir 32 by way of, for example, flexible couplings 34. The reservoir 32 may be rotatably mounted relative to vertical support 48, for example on an upper flange 46, so as to rotate with the filling turret 24. Although not illustrated in the figures, the reservoir 32 may be continuously filled from an external source. The filling operation, described in greater detail below, is conducted as the groups of containers 12 are engaged by respective filling heads 28 and are conveyed in a circular path by the platform member 18. Once the filling operation is completed, the heads 28 may be driven to their rest position, the indexing arms 36 retracted, and the containers 12 moved from the rotating platform 18 at the out-feed station 22. It should be appreciated that the filling operation may be completed within a relatively short rotational arc of the platform 18, and that the out-feed section 22 may thus be defined at a circumferential location other than adjacent to the in-feed location 20 as depicted in FIG. 1. For example, the out-feed section 22 may be defined at an arc position of about 90 degrees, 180 degrees, 270 degrees, and so forth, relative to the in-feed section 20. In the illustrated embodiment, the out-feed section 22 is defined generally adjacent to the in-feed section 20 so that the containers 12 are conveyed away from the apparatus 10 in a direction generally parallel to but opposite from their in-feed direction. This may be desirable from a space-saving aspect, machine layout, etc. This may also be the case even though the containers 12 are filled long before the containers are conveyed to the out-feed section 22.

Referring to FIG. 3, it may be desired that exit guide elements 40 are provided at the out-feed section 22 to positively convey the containers 12 from the rotating platform 18 onto the out-feed conveyor 16. As with the in-feed guide elements 38, any number and desired arrangement of exit guide elements 40 may be provided. The exit guide elements 40 extend along a circumferential portion of the rotating platform 18 so as to extend beyond the location where the filling heads 28 are driven to their rest position and the indexing arms 36 are driven to their retracted position. Thus, upon the filling elements 30 disengaging from the containers 12, the containers are positively guided by the exit guide elements 40 onto the out-feed conveyor 16.

Figure 6:
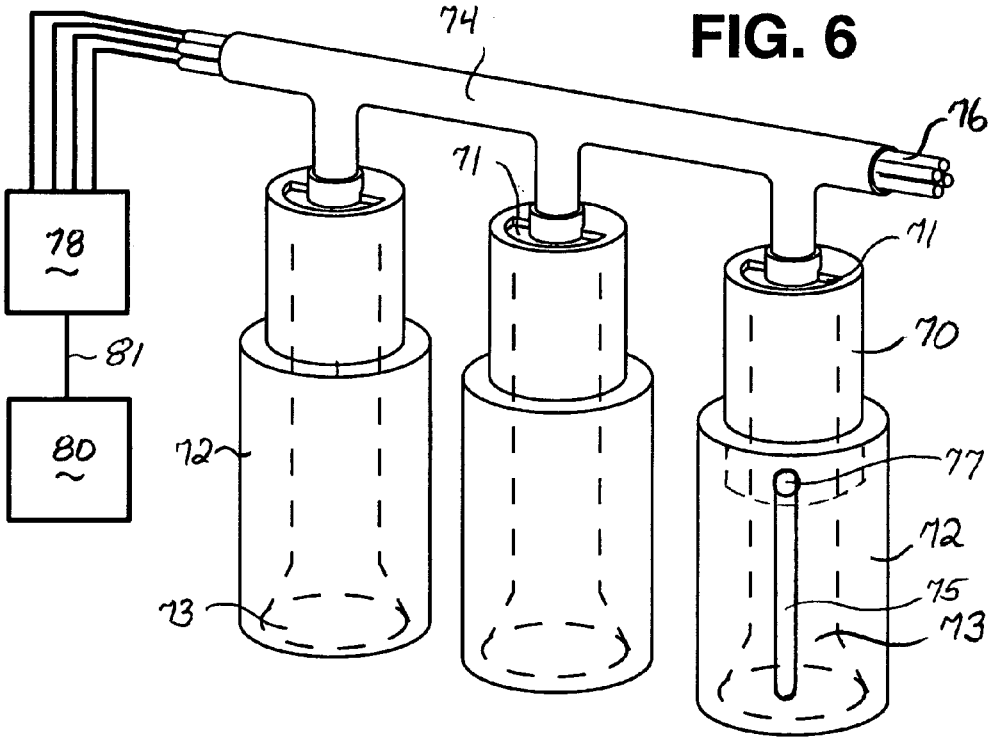
FIG. 6 is a diagrammatic view of filling elements used with a filling head in embodiments of the invention.

Referring to FIGS. 5 and 6 in particular, each filling head 28 includes an accumulator tank 60 that is supplied with a liquid from the reservoir 32 via the flexible hose coupling 34. A suitable quick-disconnect may be used to connect the hose 34 with the tank 60 to facilitate replacement or exchange of filling heads 28. Each of the filling elements 30 includes a valve element 70 having an access 71 that is opened at the appropriate time to allow liquid from the accumulator tank 60 to flow through the valve 70 and into the individual containers 12. Each filling element 30 may also include an elongated alignment sleeve 72 defining an internal passage, such as the conical passage 73 illustrated in FIG. 6. The sleeves 72 are vertically movable relative to the fixed element 70 by way of, for example, a slot 75 defined in the sleeves 72 engaging with a pin 77 or like member provided on the element 70. The sleeves 72 are biased by gravity or spring element to a lowermost position as illustrated in FIG. 6 and, as the filling elements 30 are lowered, the sleeves 72 serve to engage around the upper portion of the containers 12 and slide relative to the fixed element 70 so as to positively retain the containers during the filling sequence and their travel on the rotating member 18, as illustrated in FIG. 1.

Various embodiments and arrangements of filling heads or valves used in circular or linear filling machines are well known to those skilled in the art, and any one or combination of such conventional valves may be utilized in the present invention. Such valves are available from several commercial sources such as US Bottlers Company, Inc. of Charlotte, N.C. In a particular embodiment suited for non-carbonated beverages, such as water, fruit and vegetable juices, etc., valve 70 may be a relatively simple spring actuated device wherein lowering of the elements 30 causes the alignment cap 72 to engage with the containers 12 as described above and also to move a sealing member within the valve element 70 away from a valve seat to open access 71 such that fluid within the tank 60 may then flow through the passage 73 and into the container 12. An air vent would also be included in the valve 70 for venting and relieving air from the containers 12 during the filling operation.

In other embodiments, the filling elements 30 may require any number of different sources or mediums to carry out a filling operation, particularly in the case of carbonated beverages. For example, each filling element 30 may require one or a number of pneumatic lines, including pressurized air lines, purge lines, a vent line, and so forth. Such sources and lines are indicated schematically in FIG. 6 by the individual lines 76. It should be understood that the invention is not limited in any way by the type or requirements of the filling elements 30 and their respective valve elements 70.

In an advantageous configuration illustrated in the figures, the plurality of filling elements 30 within a respective filling head 28 are supplied with any needed lines 76 (i.e. electrical line, pneumatic line, etc.) by way of a common supply header 74 such that all of the filling elements 30 are supplied essentially simultaneously via the header 74. The header 74 is, in turn, connected to a central control member or module 78. A single such module 78 may be provided for each filling head 28, as depicted in FIG. 1. The module 78 may be disposed at any convenient location relative to the filling heads 28 for ease of maintenance, servicing, replacement, etc. Each of the modules 78 may, in turn, be connected to a master module 80 that may be disposed at any convenient location relative to the machine 10. For purposes of illustration only, the master module 80 is illustrated in FIG. 1 as positioned above the reservoir 32. The master module 80 is connected to the individual modules 78 by way of lines 81. The lines 81 may be, for example, a single or plurality of electrical/pneumatic lines for supplying each of the individual heads 28 with the sources required to operate the respective filling elements 30. Such connections may be made by, for example, quick disconnects, and so forth, for ease of maintenance, replacement, etc.

In a particular embodiment, each of the modules 78 may include one or more solenoid valves that are actuated in any desired timed sequence based on the rotational position of the respective filling head 28 to commence the filling operation by directing any combination of operational medium to the valves 70 via the header 74. The solenoid valves may be supplied with electrical control signals via the lines 81. The master module 80 may, in turn, be in communication with a central machine processor or control system for initiating the sequence of the solenoid valves. It should be appreciated by those skilled in the art that a vast array of configurations may be utilized to control the operational sequence of the filling elements, and that the present invention is not limited to any particular control configuration.

A particularly advantageous feature of the present invention is that a plurality of filling elements 30 within a respective filling head 28 may be controlled via a single module 78 and header 74, thus greatly simplifying the pneumatic/electrical connections and control systems. The individual filling elements 30 within a respective filling head 28 are not operated sequentially, and thus do not need individual control systems or modules. This greatly simplifies construction and operation of the machine.

As described, the platform 18 and components of the filling turret 24 are rotated at corresponding speeds such that there is virtually no relative movement between the filling elements 30 and containers 12 as the platform 18 and filling heads 28 are driven in their circular path. Any number of drive systems, gearing arrangements, etc., may be utilized for rotationally driving the respective components. In a relatively simple embodiment illustrated in FIG. 2, a single motor 64 drives a drive gear 66 through a transmission 63. The drive gear 66 is engaged with a ring gear 68 that is, in turn, directly or indirectly coupled to the platform 18. The platform 18 and vertical support members 42 with respective filling heads 28 slidably mounted thereon thereby rotate relative to the stationary vertical frame member 48. A drive shaft engaged with the ring gear 66 may extend through the vertical support member 48 to drive the reservoir 32. In an alternative embodiment, the vertical support member 48 may be rotated with the platform 18 being mounted directly thereto. It should be appreciated that any number of suitable drive arrangements and structural systems may be utilized for rotating the platform member 18 and filling heads 28.

As mentioned, any number and pattern of containers 12 may be indexed between respective arms 36. It may be desired for certain types of containers that only a single container 12 be indexed between respective arms 36, as illustrated diagrammatically in FIG. 8. This may be the case for larger diameter containers 12. Filling heads 28 having the corresponding number of filling elements 30 at the appropriate spacing may be exchanged with existing filling heads 28 for this purpose, particularly if quick-disconnect fittings are used between the manifolds 78 and master manifold 80, and also for the flexible coupling 34. Also, the index arms 36 can be repositioned on the platform member 18 simply by changing the location of the bearing blocks 86.

Figure 8:
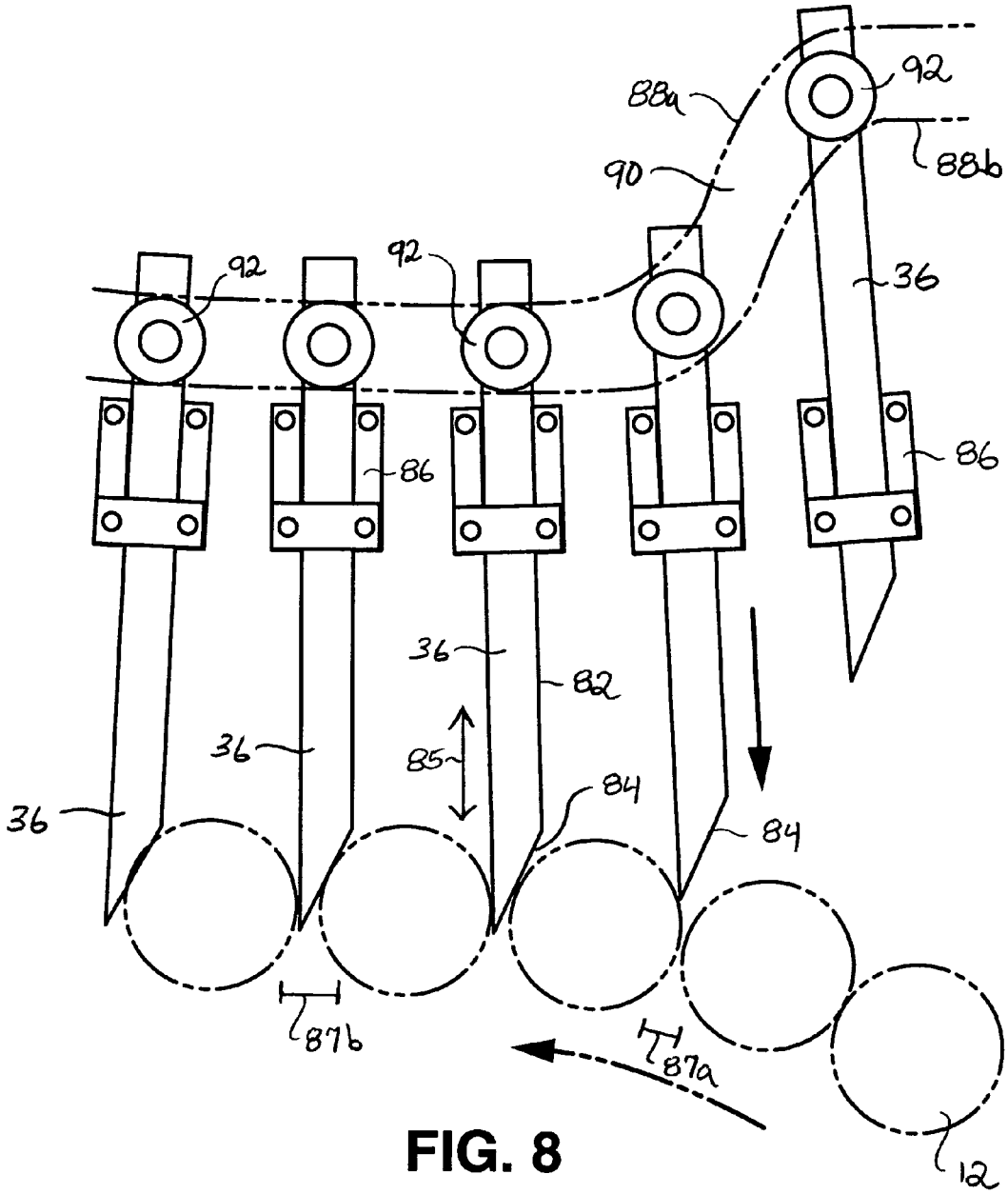
FIG. 8 is a perspective partial diagrammatic view of an alternate embodiment of a filling sequence in accordance with the invention.

In an embodiment wherein a single serial row of containers is conveyed and filled, as illustrated in FIG. 8, a unique configuration of indexing arm 36 may be utilized to accurately space the containers 12. Each of the arms 36 has a contoured face 84 that engages between adjacent containers 12. The face 84 may be, for example, a uniform or non-uniformly curved surface, a straight angled surface, etc. As indicated by the right-hand containers 12 in FIG. 8, the containers are conveyed initially onto the platform 18 with no or little spacing 87*a*. Upon extension of the arms 36, the contoured face 84 engages between adjacent containers 12 and thus separates the containers with an increased spacing 87*b* depending upon the degree of penetration of the contoured surface 84 between the containers, with a maximum spacing being equal to the width of the indexing arms 36. In this regard, the degree of radial extension of the arms 36 may be variable so that the degree of separation between the containers 12 can be precisely controlled by varying the radial extension position of the arms 36. In this regard, containers of various size may be processed without exchanging filler heads 28, but merely by adjusting the radial extension position of the arms 36. The extension position may be adjusted, for example, by relocating the position of the followers 92 along the arms 36. Alternatively, the arms 36 may be replaced by other arms having a shorter or longer length.

As mentioned, the present invention also includes various embodiments of methods for filling containers with a liquid in an automated filling operation according to the operational principles discussed herein.

It should be appreciated by those skilled in the art that various modifications and variations may be made to the embodiments described herein without departing from the scope and spirit of the invention as set forth in the appended claims and their equivalents. It is intended that the invention include such modifications and variations.

The invention claimed is:

1. A continuous circular motion filling machine for filling containers conveyed thereto, said machine comprising:

a conveyor configured to carry and convey containers to be filled;

a rotating platform having an in-feed section disposed to receive containers from said conveyor and an out-feed section disposed to transfer filled containers from said rotating platform, said rotating platform rotatable relative to a vertical rotating axis;

a filling turret disposed generally above said rotating platform and rotatable relative to said vertical rotating axis at a speed corresponding generally to that of said rotating platform, said filling turret further comprising a plurality of filling heads movable from a rest position to a filling position as said turret rotates between said in-feed and out-feed sections;

each said filling head comprising a plurality of filling elements, said filling elements moving into engagement with the containers as said filling heads move to said filling position for filling the containers;

a plurality of radially extensible and retractable indexing arms circumferentially spaced around said rotating platform, said indexing arms retracted at said in-feed section and subsequently extended as said rotating platform rotates so as to index the containers into groups on said rotating platform between said indexing arms, each said group associated with a respective said filling head and arranged in a pattern corresponding to the pattern of said filling elements of said respective filling head.

2. The filling machine as in claim 1, further comprising in-feed guide elements disposed generally at said in-feed section so as to guide the containers from said conveyor onto said rotating platform in a desired pattern.

3. The filling machine as in claim 2, wherein said in-feed guide elements are disposed so as to convey the containers onto said rotating platform in a single serial row.

4. The filling machine as in claim 2, wherein said in-feed guide elements are disposed so as to convey the containers onto said rotating platform in multiple parallel rows.

5. The filling machine as in claim 2, wherein said in-feed guide elements extend around at least a portion of the circumference of said rotating platform, said filling heads movable from said rest position to said filling position before the containers are moved beyond said in-feed guide elements.

6. The filling machine as in claim 2, further comprising exit guide elements disposed generally at said out-feed section of said rotating platform.

7. The filling machine as in claim 6, wherein said filling heads are movable from said filling position to said rest position after the containers are moved into said exit guide elements.

8. The filling machine as in claim 1, further comprising in-feed guide elements disposed generally at said in-feed section so as to guide the containers from said conveyor onto said rotating platform in a desired pattern, and exit guide elements disposed generally at said exit section of said rotating platform, said filling heads movable from said rest position to said filling position before the containers are moved beyond said in-feed guide elements and movable from said filling position to said rest position after the containers are moved into said exit guide elements.

9. The filling machine as in claim 1, wherein said indexing arms are cam actuated between their extended and retracted positions as said rotating platform rotates about said vertical axis.

10. The filling machine as in claim 1, wherein said filling heads are vertically movable between said rest and filling positions as said filling heads rotate with said filling turret.

11. The filling machine as in claim 10, wherein said filling heads are movably supported on generally vertically oriented support arms disposed circumferentially around said filling turret, said filling heads driven in a reciprocating vertical path on said support arms.

12. The filling machine as in claim 11, wherein said filing heads are engaged with a cam track as said filling turret rotates, said cam track driving said filling head in said vertical path on said support arms.

13. The filling machine as in claim 1, further comprising a reservoir disposed generally atop said rotating turret, said filling heads comprising accumulator tanks supplied with a filling liquid from said reservoir.

14. The filling machine as in claim 13, wherein said filling elements associated with each said filling head are in fluid communication with said accumulator tank and include valve elements having an open position for dispensing liquid into the containers and a closed position for preventing the dispensing of liquid after the containers are filled.

15. The filling machine as in claim 14, wherein each said filing head comprises a central control member, said control member supplied with any combination of electrical and pneumatic lines for actuating and controlling said filling elements of said respective filling head, said filling elements in communication with said control member for generally simultaneous operation.

16. The filling machine as in claim 15, wherein said filling heads are connected to said control member by a common header line.

17. The filling machine as in claim 15, wherein said filling heads are individually connected to said control member.

18. The filling machine as in claim 1, wherein the groups of containers are conveyed in contact against each other between said indexing arms, said indexing arms having a width and circumferential spacing to ensure that individual containers within said group are generally aligned with said filling elements of a respective said filling head.

19. The filling machine as in claim 1, wherein said indexing arms comprise a shaped tip having an angled surface at a following side of said arm in a direction of rotation of said rotating platform such that upon extension of said indexing arms from their retracted position, line pressure of the containers is relieved to the following side of said arms.

20. The filling machine as in claim 1, wherein said conveyor and said rotating platform comprise a continuous moving surface.

21. The filling machine as in claim 1, wherein said rotating platform is a generally circular platform separate from said conveyor.

22. The filling machine as in claim 1, wherein said indexing arms comprise an angled leading edge surface and are variably positionable in a radial direction such that circumferential spacing between the containers is varied by adjusting the radial position of said indexing arms.

23. The filling machine as in claim 22, further comprising in-feed guide elements disposed generally at said in-feed section so as to guide the containers from said conveyor onto said rotating platform in a single serial row, said indexing arms being of a number and spacing so as to be extendable between each of the containers; and whereby containers of varying size are accommodated by adjusting the degree of radial extension of said indexing arms.

24. A continuous circular motion filling machine for filling containers conveyed thereto, said machine comprising:

a rotating platform having an in-feed section disposed to receive empty containers and an out-feed section disposed to transfer filled containers from said rotating platform, said rotating platform rotatable relative to a vertical rotating axis;

a filling turret disposed generally above said rotating platform and rotatable at a speed corresponding generally to that of said rotating platform, said filling turret further comprising a plurality of circumferentially disposed filling elements movable between a rest position and a filling position as said turret rotates between said in-feed and out-feed sections;

a plurality of radially extensible and retractable indexing arms circumferentially spaced around said rotating platform, said indexing arms retracted at said in-feed section and subsequently extended as said rotating platform rotates so as to index the containers into groups on said rotating platform between said indexing arms, each said group arranged in a desired pattern and spacing between adjacent said indexing arms corresponding to a pattern and spacing of said filling elements; and wherein said filling elements are movable from said rest position to said filling position subsequent to indexing of the containers by said indexing arms for filling the containers.

25. The filling machine as in claim 24, further comprising an in-feed conveyor disposed to deliver containers to said in-feed section and an out-feed conveyor disposed to transfer filled containers from said out-feed section.

26. The filling machine as in claim 25, wherein said in-feed and out-feed conveyors and said rotating platform comprise a continuous moving platform.

27. The filling machine as in claim 25, wherein said rotating platform is a separate component from said in-feed and out-feed conveyors.

28. The filling machine as in claim 24, wherein said indexing arms are circumferentially spaced such that each said group of the indexed containers contains at least one container.

29. The filling machine as in claim 24, wherein said indexing arms are circumferentially spaced such that each said group of the indexed containers contains a plurality of containers arranged in a single serial row.

30. The filling machine as in claim 24, wherein said indexing arms are circumferentially spaced such that each said group of the indexed containers contains a plurality of containers arranged in multiple parallel rows.

31. The filling machine as in claim 24, wherein said filling turret comprises a plurality of circumferentially disposed filling heads, said filling heads disposed generally above said rotating platform and rotatable at a speed corresponding to the rotational speed of said rotating platform, each said filling head comprising a grouping of said filling elements arranged in a pattern corresponding to a pattern of the indexed container groups.

32. The filling machine as in claim 31, wherein each said filling head comprises an accumulator tank for supplying a filling liquid to said filling heads.

33. The filling machine as in claim 32, further comprising a central reservoir, said accumulator tanks in fluid communication with said reservoir for supplying said filling liquid to said accumulator tanks.

34. The filling machine as in claim 31, wherein said filling heads are vertically movable between said rest and filling positions as said filling heads rotate with said filling turret.

35. The filling machine as in claim 34, wherein said filling heads are movably supported on generally vertically oriented support arms disposed circumferentially around said filling turret, said filling heads driven in a reciprocating vertical path on said support arms.

36. The filling machine as in claim 35, wherein said filling heads are conveyed along a cam track as said filling turret rotates, said cam track driving said filling heads in a reciprocating vertical path as said filling turret rotates.

37. A method for filling containers in an automated filling operation, comprising:

conveying a generally continuous stream of adjacent contacting containers to an in-feed section of a circular filling machine;

at the in-feed section, transferring the continuous stream of containers onto a generally circular rotating path;

after said transferring, indexing the continuous stream of containers on the circular rotating path into groups having a desired number of containers in each group; after said indexing, engaging the containers with respective rotating filling elements; and filling the containers with the filling elements as there are conveyed along an arcuate portion of the circular rotating path.

38. The method as in claim 37, comprising indexing the continuous stream of containers into groups of at least one container with indexing arms that are extendable and retractable relative to the circular rotating path.

39. The method as in claim 37, comprising conveying the containers to the in-feed section with an in-feed conveyor and subsequently transferring the containers to a rotating platform that defines the circular rotating path.

40. The method as in claim 37, comprising conveying the containers to the in-feed section and along the circular rotating path on a continuous conveyor.

41. The method as in claim 37, comprising moving the filling heads in a reciprocating vertical path between a rest position and a filling position as the filling heads rotate.

42. The method as in claim 37, comprising indexing the containers into groups of one container.

43. The method as in claim 42, comprising indexing the containers with a radially extendable indexing arm and controlling the circumferential spacing between adjacent containers by varying the degree of radial extension of the indexing arms.

44. The method as in claim 37, comprising indexing the containers into groups of a plurality of containers.

45. The method as in claim 44, wherein the plurality of containers within each group are maintained in contact with each other.

46. The method as in claim 44, comprising indexing the plurality of containers into a single serial row within each group.

47. The method as in claim 44, comprising indexing the plurality of containers into multiple parallel rows within each group.

48. The method as in claim 37, comprising conveying the filled containers from the circular rotating path at an out-feed section to an out-feed conveyor.

49. A continuous circular motion filling machine for filling containers conveyed thereto, said machine comprising:

a rotating platform having an in-feed section disposed to receive empty containers and an out-feed section disposed to transfer filled containers from said rotating platform, said rotating platform rotatable relative to a vertical rotating axis;

a filling turret disposed generally above said rotating platform and rotatable at a speed corresponding generally to that of said rotating platform, said filling turret further comprising a plurality of circumferentially disposed filling elements movable vertically between a rest position and a filling position as said turret rotates between said in-feed and out-feed sections, each filling element contacting a respective one of the containers when in said filling position;

an in-feed guide element disposed generally at said in-feed section so as to guide the containers from said conveyor onto said rotating platform in a desired pattern, said in-feed guide element extending around at least a portion of the circumference of said rotating platform; and each of said filling elements moving vertically downward from said rest position to said filling position before the respective one of the containers is moved beyond said in-feed guide elements.

50. The filling machine as in claim 49, further comprising a plurality of radially extensible and retractable indexing arms circumferentially spaced around said rotating platform, said indexing arms retracted at said in-feed section and subsequently extended as said rotating platform rotates so as to index the containers into groups of at least one container on said rotating platform between said indexing arms, each said group arranged in a desired pattern and spacing between adjacent said indexing arms corresponding to a pattern and spacing of said filling elements.

51. A method for filling containers in an automated filling operation, comprising:

conveying a generally continuous stream of adjacent contacting containers to an in-feed section of a circular filling machine;

at the in-feed section, transferring the continuous stream of adjacent contacting containers onto a generally circular rotating path and conveying the articles around the rotating path in adjacent contact with each other;

indexing the continuous stream of containers on the circular rotating path into groups having a desired number of containers in each group such that a circumferential space is defined between the containers of different groups;

after said transferring, engaging the containers with respective rotating filling elements; and filling the containers with the filling elements as they are conveyed along an arcuate portion of the circular rotating path.

* * * * *